US011278470B2

(12) United States Patent
Zou et al.

(10) Patent No.: US 11,278,470 B2
(45) Date of Patent: Mar. 22, 2022

(54) STEAM PHYSIOTHERAPEUTIC DEVICE

(71) Applicant: Jianhan Zou, Xiamen (CN)

(72) Inventors: Jianhan Zou, Xiamen (CN); Guoyun Tang, Xiamen (CN); Hehai Liu, Xiamen (CN)

(73) Assignee: Jianhan Zou, Xiamen (CN)

( * ) Notice: Subject to any disclaimer, the term of this patent is extended or adjusted under 35 U.S.C. 154(b) by 44 days.

(21) Appl. No.: 16/968,127

(22) PCT Filed: Sep. 30, 2019

(86) PCT No.: PCT/CN2019/109524
§ 371 (c)(1),
(2) Date: Aug. 6, 2020

(87) PCT Pub. No.: WO2020/064013
PCT Pub. Date: Apr. 2, 2020

(65) Prior Publication Data

US 2021/0220218 A1 Jul. 22, 2021

(30) Foreign Application Priority Data

Sep. 30, 2018 (CN) ..... 201821612824.4

(51) Int. Cl.
*A61H 33/06* (2006.01)

(52) U.S. Cl.
CPC ..... *A61H 33/06* (2013.01); *A61H 2033/068* (2013.01); *A61H 2201/5053* (2013.01); *A61H 2205/12* (2013.01)

(58) Field of Classification Search
CPC ..... A61H 33/06
(Continued)

(56) References Cited

U.S. PATENT DOCUMENTS

| | | | | |
|---|---|---|---|---|
| 4,314,138 | A | 2/1982 | Itoh | 219/276 |
| 5,832,177 | A | 11/1998 | Shinagawa et al. | 392/394 |
| 6,243,533 | B1 | 6/2001 | Stern | 392/405 |

FOREIGN PATENT DOCUMENTS

| | | | |
|---|---|---|---|
| CN | 1924166 | A | 3/2007 |
| CN | 1978730 | A | 6/2007 |

(Continued)

OTHER PUBLICATIONS

International Search Report dated Jan. 7, 2020, issued to International Application No. PCT/CN2019/109524.

*Primary Examiner* — Lori L Baker
(74) *Attorney, Agent, or Firm* — Stein IP, LLC

(57) ABSTRACT

A steam physiotherapeutic device comprises a water tank, a boiler with a steam outlet, a liquid inlet channel for communicating the water tank with the boiler, a water valve mechanism for controlling the liquid inlet channel to open or close, and a heating mechanism configured in the boiler, wherein the heating mechanism is used for heating water flowing into the boiler to generate steam; the liquid inlet channel comprises a first passage with a water inlet section communicated with the water tank, a second passage with a water outlet section communicated with the boiler, and a third passage communicated with a water outlet section of the first passage and a water inlet section of the second passage; the first passage extends in the horizontal direction, and the second passage also extends in the horizontal direction; and the height of the second passage in the steam physiotherapeutic device is greater than that of the first passage in the steam physiotherapeutic device, and the third passage is communicated with the first passage and the second passage. The steam physiotherapeutic device prevents the drawback of water backflow.

6 Claims, 2 Drawing Sheets

(58) Field of Classification Search
USPC ..... 4/524, 535; 126/350.2; 607/1, 83, 81
See application file for complete search history.

(56) References Cited

FOREIGN PATENT DOCUMENTS

| | | | | | |
|---|---|---|---|---|---|
| CN | 101173472 | A | | 5/2008 | |
| CN | 102860797 | A | | 1/2013 | |
| CN | 204683356 | U | | 10/2015 | |
| CN | 206534503 | U | | 10/2017 | |
| CN | 209187477 | U | * | 8/2019 | ..... A61H 1/00 |
| CN | 209187477 | U | | 8/2019 | |
| JP | 2001-145684 | A | | 5/2001 | |

* cited by examiner

【FIG. 1】
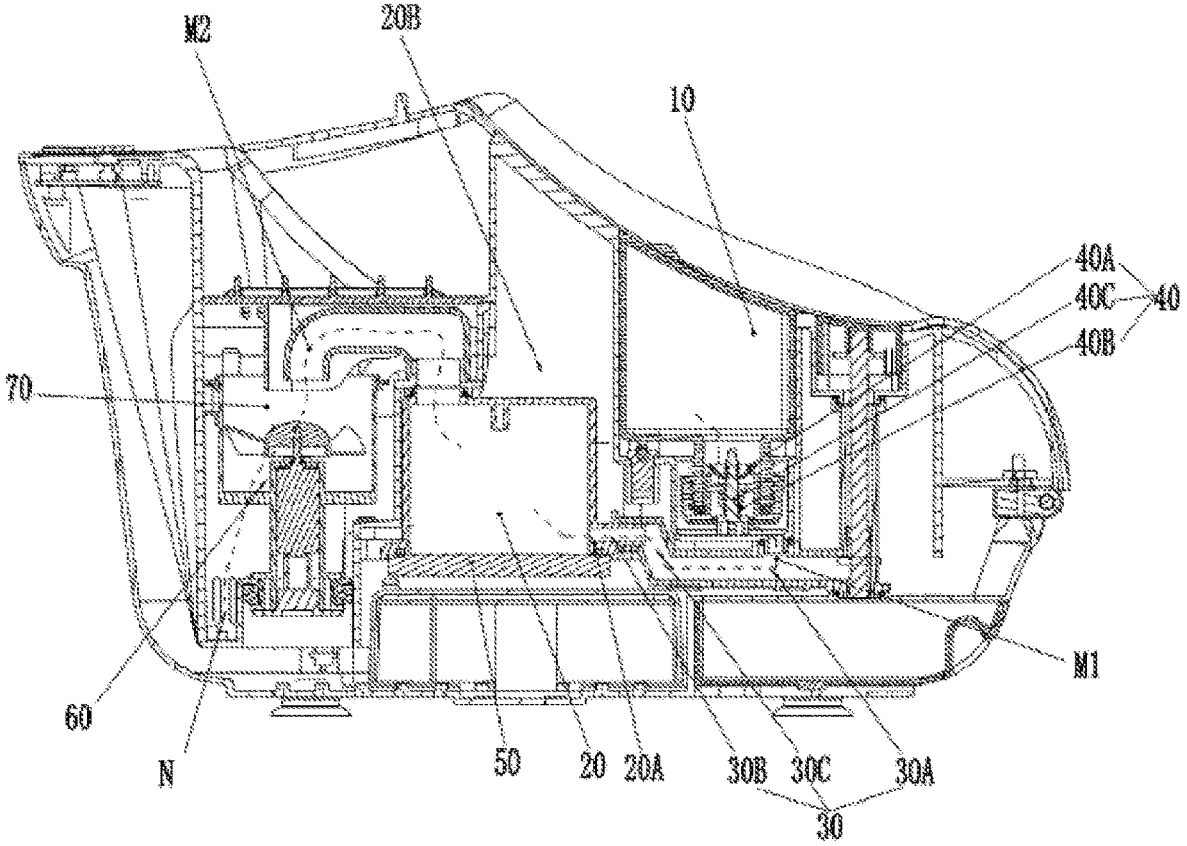

【FIG. 2】
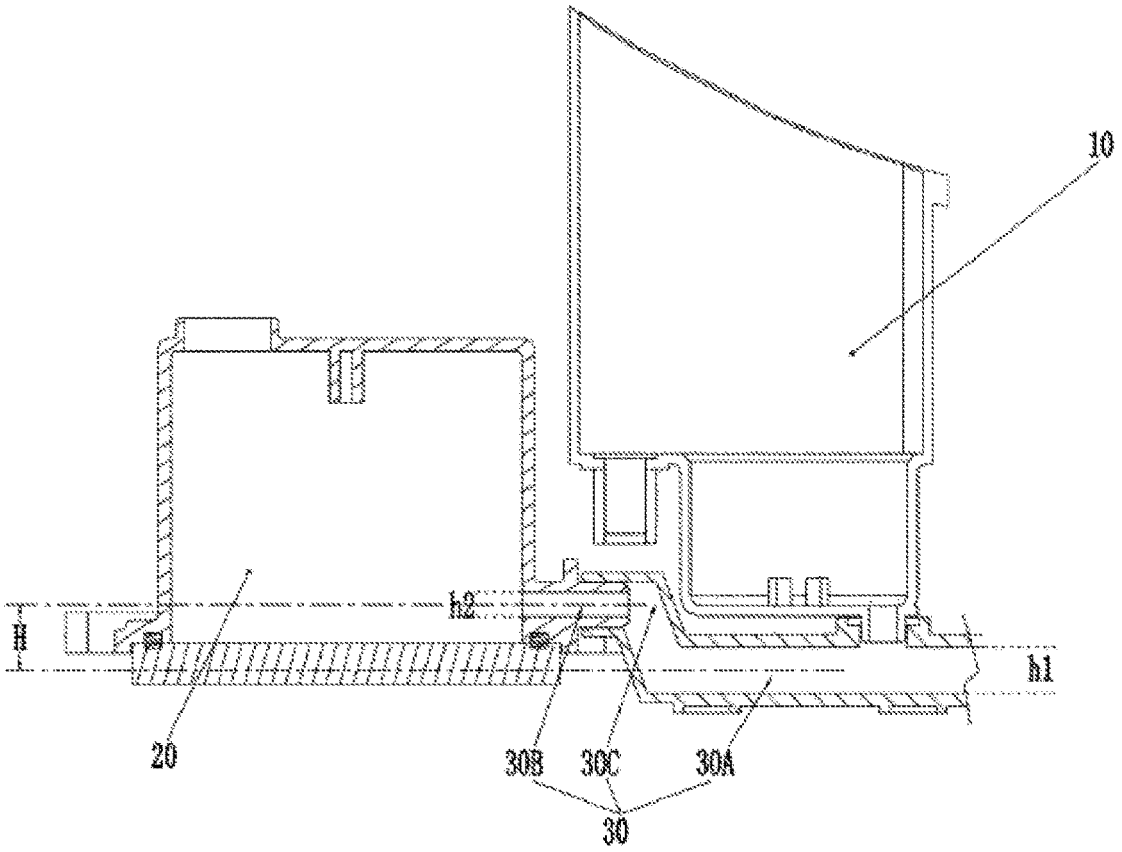

STEAM PHYSIOTHERAPEUTIC DEVICE

CROSS-REFERENCE TO RELATED APPLICATIONS

This application is a national stage of International Application No. PCT/CN2019/109524, filed Sep. 30, 2019, which claims the benefit of Chinese Application No. 201821612824.4, filed Sep. 30, 2018, in the China National Intellectual Property Administration, the disclosures of which are incorporated herein by reference.

TECHNICAL FIELD

The invention relates to a steam physiotherapeutic device, in particular to a steam physiotherapeutic device capable of overcoming the drawback of water backflow of the prior art.

DESCRIPTION OF RELATED ART

Steam footbaths, as common steam physiotherapeutic devices, typically include a water tank, a boiler with a steam outlet, a liquid inlet channel for communicating the water tank with the boiler, a water valve mechanism for controlling the liquid inlet channel to open or close, and a heating mechanism configured in the boiler. The entire liquid inlet channel of existing steam physiotherapeutic devices generally extends in the horizontal direction to communicate a water inlet section of the water tank with a water outlet section of the boiler, and there is no height difference between the water inlet section of the water tank and the water outlet section of the boiler. Such design has the following drawbacks: after water flowing into the boiler from the water tank along the liquid inlet channel is heated and boiled by the heating mechanism, it is difficult to discharge steam via the steam outlet within a short time, the air pressure in the boiler will be increased by steam accumulated in the boiler, and non-vaporized water may be pushed to flow back into the water tank when the steam accumulates to a certain degree, thus resulting in undesired losses. In view of this, the present application is put forward.

BRIEF SUMMARY OF THE INVENTION

Technical Issue

The technical issue to be settled by the invention is to provide a steam physiotherapeutic device to overcome the drawback of heat losses of existing steam physiotherapeutic devices caused by backflow of water into the water tank.

Solution to the Issue

To settle the aforesaid technical issue, the invention provide a steam physiotherapeutic device which comprises a water tank, a boiler with a steam outlet, a liquid inlet channel for communicating the water tank with the boiler, a water valve mechanism for controlling the liquid inlet channel to open or close, and a heating mechanism configured in the boiler, wherein the heating mechanism is used for heating water flowing into the boiler to generate steam; the water valve mechanism is used for isolating the water tank from the liquid inlet channel and controlling the quantity of water flowing into the liquid inlet channel to ensure that the water level in the liquid inlet channel is flush with the water level in the boiler; the liquid inlet channel comprises a first passage with a water inlet section communicated with the water tank, a second passage with a water outlet section communicated with the boiler, and a third passage communicated with a water outlet section of the first passage and a water inlet section of the second passage; the first passage extends in a horizontal direction, and the second passage also extends in the horizontal direction; and the height of the second passage in the steam physiotherapeutic device is greater than that of the first passage in the steam physiotherapeutic device, and the third passage is communicated with the first passage and the second passage.

Preferably, the size of the first passage in a vertical direction is h1, a size of the second passage in the vertical direction is h2, and a height difference between the central axis of the second passage and the central axis of the first passage is H, wherein H is greater than or equal to (h1+h2)/2.

Preferably, the third passage extends obliquely.

Preferably, the steam physiotherapeutic device has a steam diffusion channel communicated with the steam outlet and further comprises a fan assembly for driving air to flow out of the steam diffusion channel.

Preferably, the steam physiotherapeutic device is a garment steamer or a steam footbath.

By adoption of the above technical solution, the invention fulfills the following technical effects: the liquid inlet channel comprises the first passage and the second passage which are located at different heights, and in the initial state, the water pressure of the water inlet section of the first passage is higher than that of the water outlet section of the second passage; and when the air pressure in the boiler is increased, the air pressure in the boiler will not be able to push water to flow back unless it overcomes the pressure difference between the water pressure of the water inlet section of the first passage and the water pressure of the second passage and is further increased. Compared with the design that the water pressure of the water inlet section of the first passage is basically equal to that of the water outlet section of the second passage in the prior art, the design of the invention increases the air pressure that can push water to flow back in the boiler, thus overcoming the drawback of water backflow of the prior art.

BRIEF DESCRIPTION OF THE SEVERAL VIEWS OF THE DRAWINGS

FIG. 1 is a sectional view of a steam physiotherapeutic device in one embodiment of the present application.

FIG. 2 is a partial sectional view of a water tank, a boiler and a liquid inlet channel of the steam physiotherapeutic device in one embodiment of the present application.

DETAILED DESCRIPTION OF THE INVENTION

To make the purposes, technical solutions and advantages of the implementations of the invention clearer, the technical solutions of the implementations of the invention are explicitly and completely described below in conjunction with the accompanying drawings of the implementations. Obviously, the implementations described hereinafter are merely illustrative ones, and are not all possible ones of the invention. All other implementations obtained by those ordinarily skilled in the art on the basis of the following ones without creative labor should also fall within the protection scope of the invention. Therefore, the following detailed description of the implementations provided by the accompanying drawings is not intended to limit the protection scope of the invention, and is merely used to illustrate specified implementations of the invention.

Referring to FIG. 1 and FIG. 2, in this embodiment, a steam physiotherapeutic device provided by the present application is a steam footbath and comprises a water tank 10, a boiler 20, a liquid inlet channel 30 for communicating the water tank 10 with the boiler 20, a water valve mechanism 40 for controlling the liquid inlet channel 30 to open or close, and a heating mechanism 50 configured in the boiler 20. The boiler 20 has a liquid inlet 20A and a steam outlet 20B. The heating mechanism 50 is used for heating water flowing into the boiler 20 to generate steam. The water valve mechanism 40 is used for isolating the water tank 10 from the liquid inlet channel 30 and controlling the quantity of water flowing into the liquid inlet channel 30 to ensure that the water level in the liquid inlet channel 30 is flush with the water level in the boiler 20.

The water tank 10 may be a common stationary water tank or a detachable water tank. The water valve mechanism 40 comprises a water valve 40A, a spring 40B and a guide pillar 40C, wherein the water valve 40A is disposed around the guide pillar 40C, and the spring 40B abuts against the lower end of the water valve 40A and the lower end of the guide pillar 40C. The water valve 40A fits a water outlet of the water tank 10 in size and can compress the spring 40B under the effect of a water pressure to allow water to flow into the liquid inlet channel 30. The water valve mechanism 40 may also be other common mechanisms.

The liquid inlet channel 30 comprises a first passage 30A, a second passage 30B and a third passage 30C. A water inlet section of the first passage 30A is communicated with the water tank 10, a water outlet section of the second passage 30B is communicated with the liquid inlet 20A of the boiler 20, and the third passage 30C is communicated with a water outlet section of the first passage 30A and a water inlet section of the second passage 30B. Water flows approximately along dotted line M1 in the figure. The first passage 30A extends in the horizontal direction, and the second passage 30B also extends in the horizontal direction. As shown in the figures, the height of the second passage 30B in the steam physiotherapeutic device is greater than that of the first passage 30A in the steam physiotherapeutic device, and a height difference between the second passage 30B and the first passage 30A is set according to the heights of central axes of the first passage 30A and the second passage 30B. Specifically, in this embodiment, the size of the first passage 30A in the vertical direction is h1, the size of the second passage 30B in the vertical direction is h2, and the height difference between the second passage 30B and the first passage 30A is H, wherein H is greater than or equal to (h1+h2)/2. By adoption of such configuration, there is a sufficient pressure difference between the water inlet section of the first passage 30A and the water outlet section of the second passage 30B. In this embodiment, the third passage 30C obliquely extends in an S shape or in other shapes.

In this embodiment, the steam physiotherapeutic device has a steam diffusion channel 70 communicated with the steam outlet 20B and further comprises a fan assembly 60 for driving air to flow to an air outlet end N from the steam diffusion channel 70, and a flow path of steam along the steam diffusion channel 70 is approximately shown by dotted line M2.

The invention claimed is:

1. A steam physiotherapeutic device, comprising a water tank (10), a boiler (20) with a steam outlet (20B), a liquid inlet channel (30) for communicating the water tank (10) with the boiler (20), a water valve mechanism (40) for controlling the liquid inlet channel (30) to open or close, and a heating mechanism (50) configured in the boiler (20), wherein the heating mechanism (50) is used for heating water flowing into the boiler (20) to generate steam; the water valve mechanism (40) is used for isolating the water tank (10) from the liquid inlet channel (30) and controlling the quantity of water flowing into the liquid inlet channel (30) to ensure that a water level in the liquid inlet channel (30) is flush with a water level in the boiler (20); the liquid inlet channel (30) comprises:

a first passage (30A) with a water inlet section communicated with the water tank (10);

a second passage (30B) with a water outlet section communicated with the boiler (20); and a third passage (30C) communicated with a water outlet section of the first passage (30A) and a water inlet section of the second passage (30B);

the first passage (30A) extends in a horizontal direction, and the second passage (30B) also extends in the horizontal direction; and a height of the second passage (30B) in the steam physiotherapeutic device is greater than that of the first passage (30A) in the steam physiotherapeutic device, and the third passage (30C) is communicated with the first passage (30A) and the second passage (30B).

2. The steam physiotherapeutic device according to claim 1, wherein a size of the first passage (30A) in a vertical direction is h1, a size of the second passage (30B) in the vertical direction is h2, and a height difference between a central axis of the second passage (30B) and a central axis of the first passage (30A) is H, wherein H is greater than or equal to (h1+h2)/2.

3. The steam physiotherapeutic device according to claim 2, wherein the third passage (30C) extends obliquely.

4. The steam physiotherapeutic device according to claim 1, wherein the steam physiotherapeutic device has a steam diffusion channel (70) communicated with the steam outlet (20B) and further comprises a fan assembly (60) for driving air to flow out of the steam diffusion channel (70).

5. The steam physiotherapeutic device according to claim 1, wherein the steam physiotherapeutic device is a steam footbath.

6. The steam physiotherapeutic device according to claim 2, wherein the steam physiotherapeutic device has a steam diffusion channel (70) communicated with the steam outlet (20B) and further comprises a fan assembly (60) for driving air to flow out of the steam diffusion channel (70).

* * * * *